US008292528B2

(12) United States Patent
Ovens

(10) Patent No.: US 8,292,528 B2
(45) Date of Patent: Oct. 23, 2012

(54) APPLICATOR FOR APPLYING MATERIAL SUCH AS MASTIC TO A SURFACE

(75) Inventor: Melvin Larry Ovens, Vernon (CA)

(73) Assignee: Melvin Larry Ovens, Vernon, British Columbia (CA)

( * ) Notice: Subject to any disclaimer, the term of this patent is extended or adjusted under 35 U.S.C. 154(b) by 829 days.

(21) Appl. No.: 12/362,568

(22) Filed: Jan. 30, 2009

(65) Prior Publication Data

US 2010/0196078 A1 Aug. 5, 2010

(51) Int. Cl.
*A46B 11/00* (2006.01)

(52) U.S. Cl. ..... 401/48; 401/5

(58) Field of Classification Search ..... 401/5, 48
See application file for complete search history.

(56) References Cited

U.S. PATENT DOCUMENTS

| | | | | |
|---|---|---|---|---|
| 2,413,684 | A * | 1/1947 | Ames | 425/87 |
| 3,124,826 | A * | 3/1964 | Middlebrooks | 118/103 |
| 3,451,757 | A * | 6/1969 | Stroud et al. | 401/139 |
| 4,032,283 | A | 6/1977 | Johnson et al. | |
| 4,116,604 | A | 9/1978 | Johnson et al. | |
| 4,516,868 | A * | 5/1985 | Molnar | 401/5 |
| 5,143,264 | A | 9/1992 | MacMillan | |
| 5,670,182 | A | 9/1997 | Mower | |
| 5,814,351 | A | 9/1998 | Mower | |
| 5,882,691 | A | 3/1999 | Conboy | |
| 6,146,039 | A | 11/2000 | Pool et al. | |
| 6,155,809 | A | 12/2000 | Edwards et al. | |
| 6,869,492 | B1 | 3/2005 | Kooistra | |
| 6,874,965 | B1 | 4/2005 | Mondloch et al. | |
| 7,806,613 | B2 * | 10/2010 | Mondloch et al. | 401/48 |
| 2005/0100386 | A1 | 5/2005 | Murray | |

FOREIGN PATENT DOCUMENTS

| | | |
|---|---|---|
| CA | 2007430 | 7/1991 |

OTHER PUBLICATIONS

International Patent Application No. PCT/CA2010/000107, International Search Report dated Apr. 23, 2010.

* cited by examiner

*Primary Examiner* — Huyen Le
(74) *Attorney, Agent, or Firm* — Geoffrey deKleine; Borden Ladner Gervais LLP

(57) ABSTRACT

An applicator for applying drywall mastic or other material to a flat drywall surface or to an outside drywall joint or other surface comprises a body member having an upper surface and a lower surface and a pair of opposed ends, a recess in the lower surface for connection to a source of the material to be applied to the surface and at least one pair of opposed arms pivotally mounted on one of the sides of the body member for movement between deployed and retracted positions depending on whether the material is being applied to an outside corner joint or a flat surface, respectively. In another embodiment, the applicator has a pair of relatively moveable blades located in operational relationship with respect to each other for controlling flow of the material from the recess to the surface to which it is being applied.

23 Claims, 8 Drawing Sheets

APPLICATOR FOR APPLYING MATERIAL SUCH AS MASTIC TO A SURFACE

FIELD OF THE INVENTION

This invention relates to an applicator for applying joint compound, such as mastic, or other material, to a surface, such as wall board or drywall.

BACKGROUND OF THE INVENTION

Mastic applicators are known which are designed for applying mastic to joints between wall board or drywall panels. When two adjacent panels are in the same plane, their abutting edges form a flat wall joint but when two adjacent panels are not in the same plane, such as being at right angles, e.g. edges of the panels forming an outside corner, a flat surface applicator is not suitable and an applicator for negotiating the corner is required to facilitate application of mastic at an outside corner joint.

U.S. Pat. No. 5,814,351 describes an outside corner mastic applicator which has retractable corner guides with guide surface projections thereon. The guides are movable between a retractable position when the applicator is used on a flat surface and a deployed position when used on an outside corner and the guide surface projections are intended to guide the applicator along the outside corner. The applicator also includes a pair of rollers on its underside in order to support the applicator in relation to the surface. The rollers are mounted on the opposite ends of an axle that is pivotable about its centre. The rollers also each have a notch that is intended to engage with the outside corner bead.

However, in practice it has been found difficult to use the applicator on corners as an efficient means for guiding the roller to the corner is lacking. Also when using the applicator, it is often necessary to repeat the process one or more times and because the rollers are in contact with the wall, they create a line or track in the mastic. Therefore, the rollers tend to detract from the finish of the joint.

Since the rollers are mounted on the same axle, a problem that occurs is that if one roller touches the wall, the opposite roller also moves, rendering it difficult to align the applicator with the corner trim.

Because the rollers are mounted in a vertical position, it limits or hampers the applicator's ability to be used on radius corners or bulkheads that have radiuses. It requires side pressure to push the applicator against a corner bead as well as moving the applicator along the corner bead. On an inside radius, the roller binds and tends to run up the corner trim. On long runs of corner bead there usually are many joints in the bead where there is often misalignment of the bead causing the roller and the guide surface projections to catch on the misaligned bead.

When the corner guides are in the deployed position, the guide surface projections rub against the surface of the wall board often causing damage to the paper surface. The friction caused by this tends to turn the applicator slightly sideways causing the roller to come away from the corner bead and lose its guidance.

The applicator further requires the use of a fixed handle. However, when using this handle, a small movement sideways causes the roller to come off the corner, which results in difficulties in controlling the applicator.

When deploying mastic to a ceiling or a wall, the guide surface projections can damage the drywall causing the projections to catch on a lip between two adjacent sheets of wall board. This happens especially if the wallboard has been installed with uneven joints. In order to prevent this, it is necessary manually to adjust the guide surface projections to the retracted position.

It is, therefore, desirable to provide an applicator that overcomes or alleviates the above difficulties.

SUMMARY OF THE INVENTION

According to one aspect of the invention, there is provided an applicator for applying drywall mastic or other material to a flat drywall surface or to an outside corner drywall joints or other surface comprising: a body member having a front, a rear, a pair of sides and an upper surface and a lower surface, the lower surface being provided with a recess for containing the material prior to the application thereof; at least one pair of opposed arms pivotally mounted on one of the sides of the body member for movement between deployed and retracted positions about pivot points that are spaced from each other along the side of the body member, the pivot point of each arm being located at one end of the arm and the arms of the pair extending away from each other along the side of the body member, terminating at an outwardly facing end of each arm; a corner guide at the outwardly facing end of each arm extending beyond the lower surface of the body member when the arm is in the deployed position in order to track an outside edge of a drywall corner joint; and a biasing member for biasing the pair of arms to the deployed position when the arms are not located over a flat drywall surface and for allowing the arms to move to the retracted position when the arms are located over a flat drywall surface.

In an embodiment the corner guide comprises a guide roller at the outwardly facing end of each arm for rotation about an axis extending transversely of the arm, the roller extending beyond the lower surface of the body member when the arm is in the deployed position in order to track an outside edge of a drywall corner joint.

In another embodiment a pair of the opposed arms is provided on each side of the body member.

The applicator may further comprise a side roller on the side of each arm for engagement with a flat drywall surface for moving the arms to the retracted position.

The applicator may further comprise a pair of secondary rollers located on opposite sides of the body member at the rear of the body member, the secondary rollers having rolling surfaces which are tapered towards the sides of the body member.

According to another aspect of the present invention, there is provided an applicator for applying drywall mastic or other material to a drywall surface or other surface, comprising a body member having an upper surface and a lower surface, a recess in the lower surface for connection to a source of the material to be applied to the surface and a pair of relatively movable blades located in operational relationship with respect to each other for controlling flow of the material from the recess to the surface.

In one embodiment the one blade is fixed relative to the body member and the other blade is movable relative to the body member.

In a further embodiment the fixed blade has a curved edge and the movable blade has a straight edge in operational relationship with the curved edge, whereby relative movement of the blades progressively covers or uncovers the curved edge in order to control an amount of the material flowing past the blades.

The applicator may further include a mechanism for effecting relative movement of the blades, the mechanism comprising an elongate member on the body member capable of elongate movement relative to at least one of the blades, the elongate member being provided with at least one slot therein that is inclined with respect to a direction longitudinally of the at least one blade, the at least one blade being provided with a pin thereon which is located for sliding along the inclined slot, whereby longitudinal movement of the elongate member relative to the at least one blade causes movement of the at least one blade in a transverse direction relative to the other blade.

According to a further aspect of the invention, there is provided a tool for use with a handle or wand of a mastic applicator, when said handle or wand is being loaded with a charge of mastic from a container, the tool comprising a flexible member for floating on or being supported by the mastic in the container, the flexible member having an opening therein for receiving a front end of the handle or wand therethrough so as to insert said front end into the mastic for charging the handle or wand with mastic while shielding the rest of the handle or wand from contact with the mastic.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

The invention will now be described, by way of examples only, with reference to the accompanying drawings, in which.

DETAILED DESCRIPTION OF PREFERRED EMBODIMENT

Figure 1:
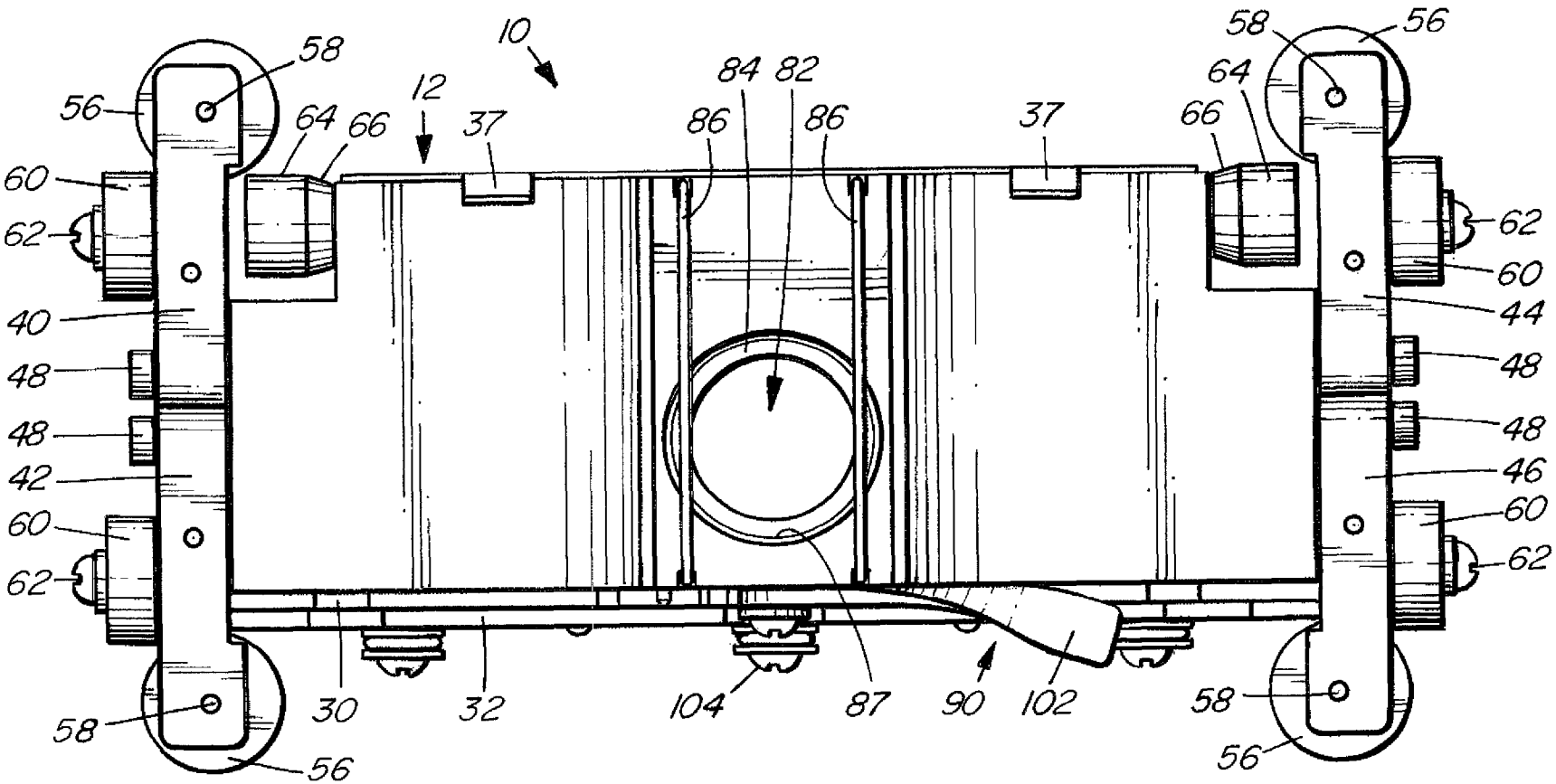
FIG. 1 is a plan view of a mastic applicator according to an embodiment of the invention.
Figure 2:
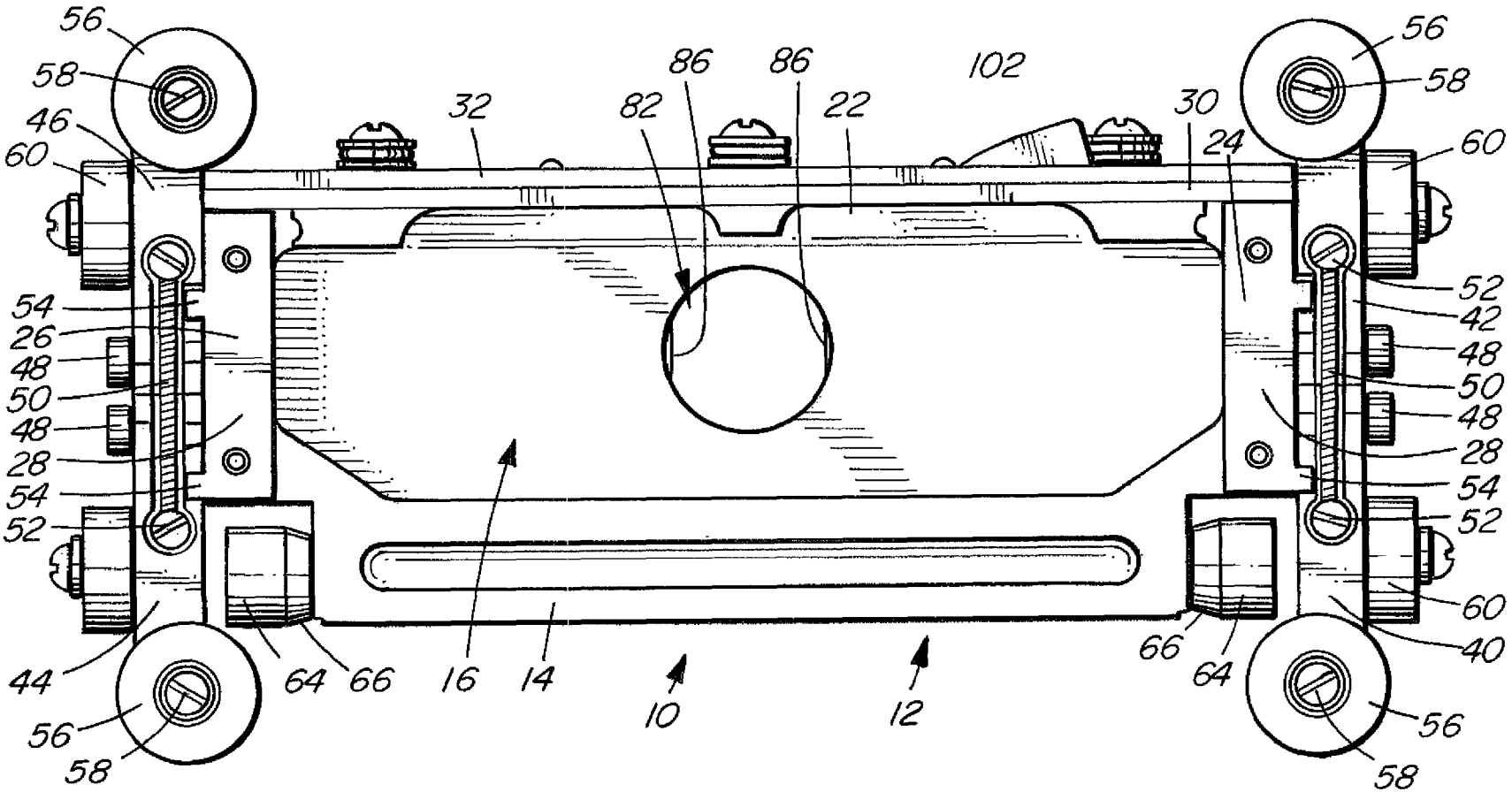
FIG. 2 is a bottom view of the applicator of FIG. 1 with a cover member omitted for the purposes of illustration.

In the following description, certain specific details are set forth in order to provide a thorough understanding of various embodiments of the invention. However, one skilled in the art will understand that the invention may be practiced without these details. In other instances, well known structures associated with the technology have not been described in detail to avoid unnecessarily obscuring the description of the embodiments of the invention.

Unless the context requires otherwise, throughout the specification and claims which follow, the word "comprise" and variations thereof, such as "comprises" and "comprising" are to be construed in an open, inclusive sense, that is as "including but not limited to."

Referring to FIGS. 1 to 7 reference numeral 10 generally indicates an applicator comprising a body member 12 having a bottom surface 14. A recess 16 is provided in the bottom surface 14 for containing mastic or other material prior to application thereof to a surface.

The recess 16 is of elongate shape with a leading edge 22 which is recessed with respect to the bottom surface 14, i.e. about 3 to 5 mm inwards of the bottom surface, in the present example.

A pair of slide plates 24, 26 are provided along the edges of the body member 12, respectively, which are in the same plane to define an applicator surface 28 which during use of the applicator 10 is in contact with the surface to which mastic or other material is being applied. For practical reasons, the slide plates 24, 26 are of hardened steel to withstand the wear.

Figure 8:
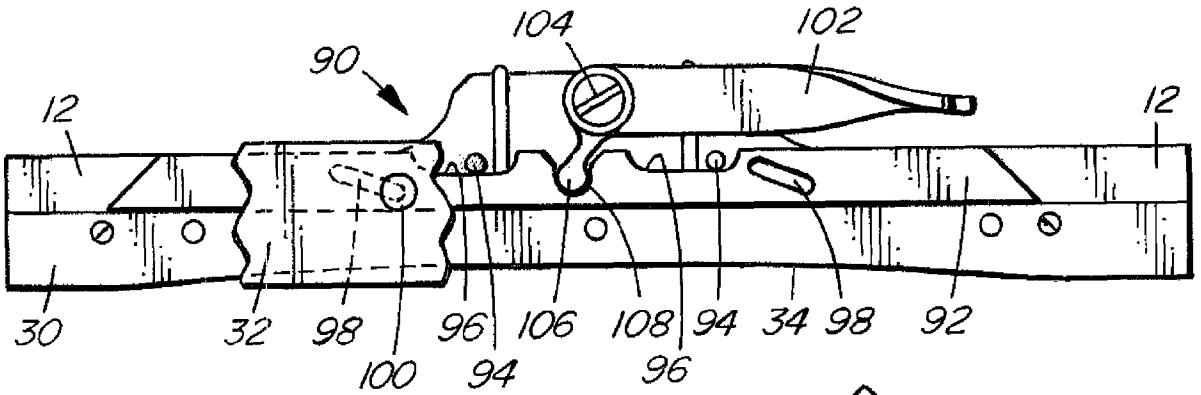
FIG. 8 is a view similar to FIG. 6 (but with some parts omitted) showing a front one of a pair of relatively movable blades removed and with a blade adjustment mechanism in one limiting position.

A pair of relatively movable blades 30 and 32 are provided adjacent the leading edge 22. The one blade 30, which is immediately adjacent the edge 22, has a generally curved or concave lower edge 34 and is fixed in position (FIG. 8). The lower edge of the blade 30 at the opposite ends thereof adjacent the slide plates 24, 26, is in the same plane as the applicator surface 28.

The other blade 32 has a straight lower edge 36 (FIG. 10) and is movable between a closed position, in which its lower edge 36 is in the same plane as the applicator surface 28, and a raised or open position in which the blade 32 is raised relative to the blade 30, in order to expose the curved lower edge 34, so as to allow the passage of the material which it is being applied to the surface. In one example, the opening provided by the curved edge 34 when the blade 32 is in the fully raised position has a width of about 1/16" to 3/32".

A cover 33 which is hingedly mounted on an axis 35 (FIG. 3) is provided for covering the recess 16. The cover 33 is provided with a pair of clips 37 (FIG. 1) for locking it in the closed position. When in the closed position, the cover 33 is slightly recessed from the applicator surface 28, i.e. to provide for a clearance between the cover 33 and the surface to which the mastic is being applied.

When in the closed position, the cover 33 prevents pressure buildup of mastic between the applicator 10 and the surface to which the mastic is being applied.

Figure 3:
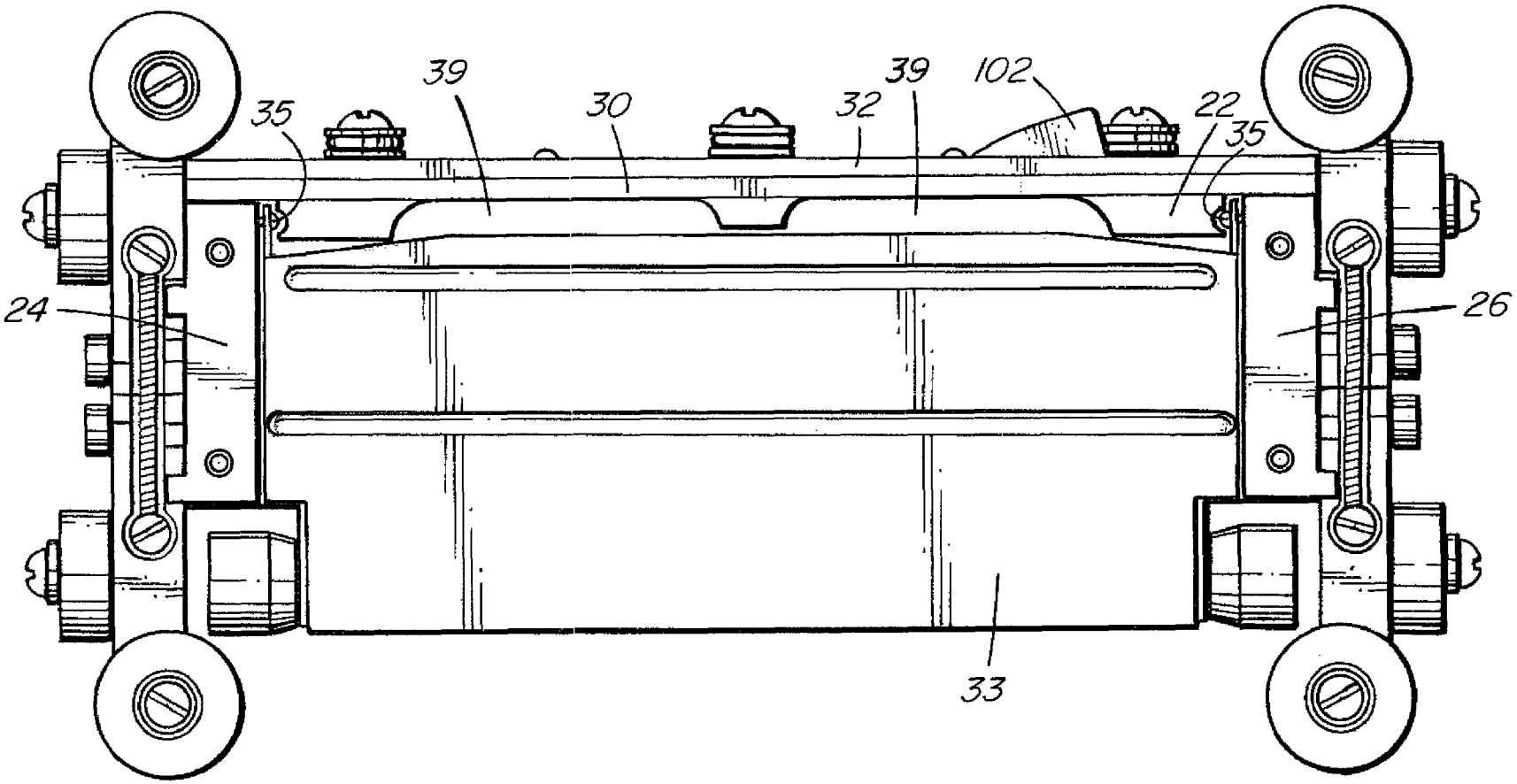
FIG. 3 is a view similar to FIG. 2 but with the cover member in place.

With reference to FIG. 3, it can be seen that the cover 33 does not cover the entire lower surface of the applicator 10 but that a gap 39 between the cover 33 and the blades 30, 32 is provided. This allows mastic to flow from the recess 16 to the surface irrespective of the relative position of the blades 30, 32. The purpose of the relatively movable blades 30, 32 is to provide for an additional adjustable flow of mastic passing the blades 30, 32 as required.

Figure 4:
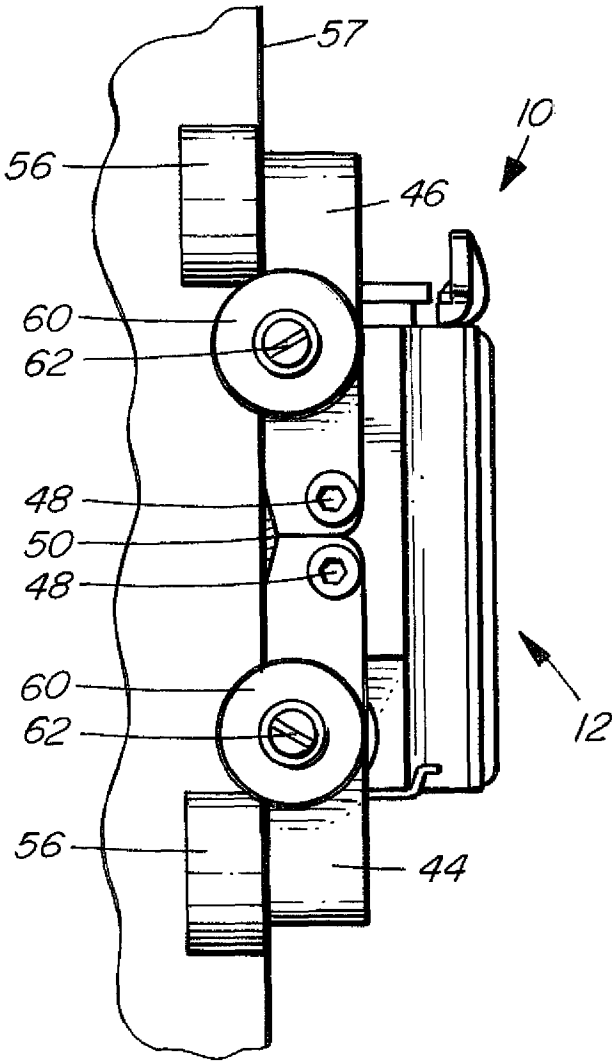
FIG. 4 is an end view of the applicator of FIG. 1 showing the applicator in engagement with an outside corner of a dry wall.
Figure 6:
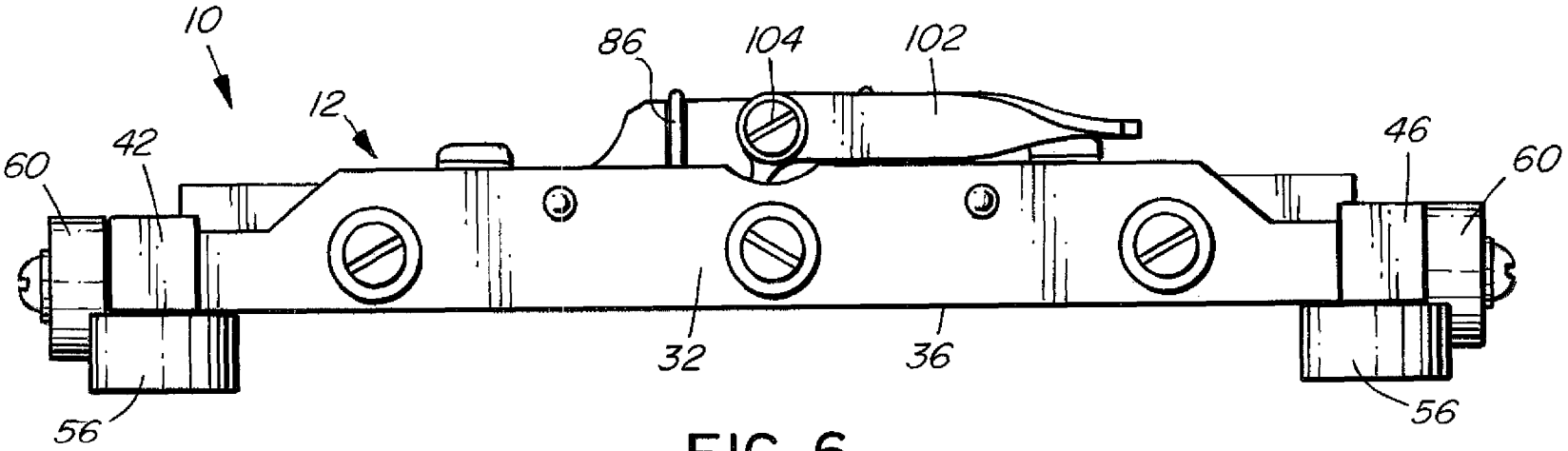
FIG. 6 is a front view of the applicator of FIG. 1.
Figure 7:
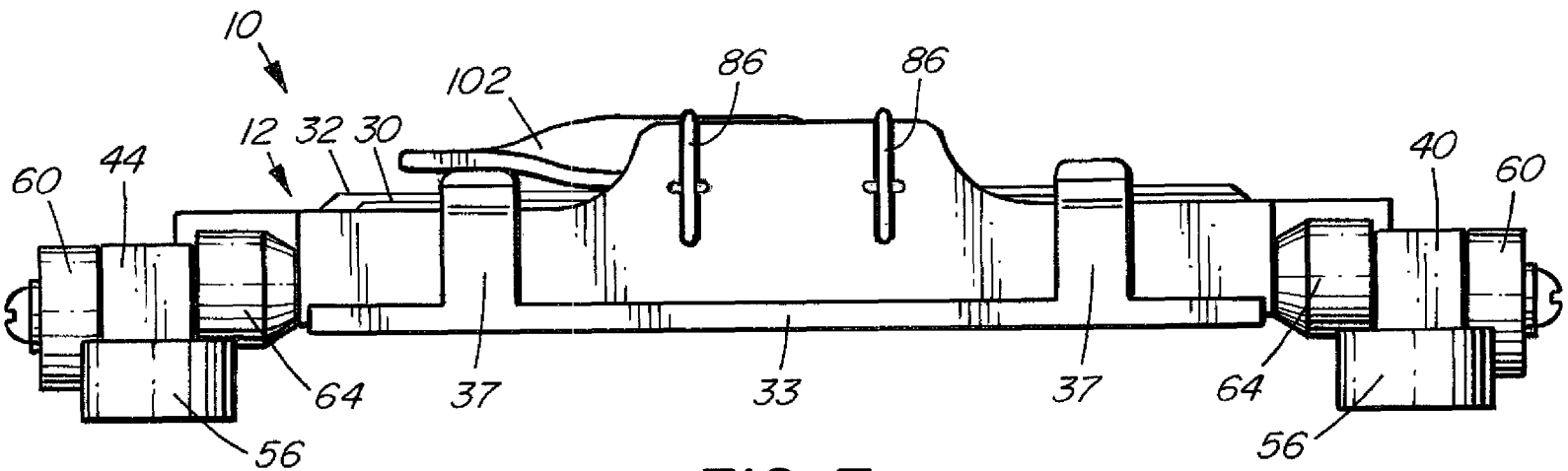
FIG. 7 is a rear view of the applicator of FIG. 1.

The applicator 10 is provided with four arms 40, 42, 44 and 46 which are pivotally mounted to the ends of the body member 12 on axes 48. As can be seen, the arms are arranged in opposed pairs 40, 42 and 44, 46 on the opposite ends of the body member 12, respectively. A coil spring 50 extends between each pair of arms for biasing each pair to a position in which they are in alignment, as shown in FIG. 4. The springs 50 are fastened to the arms by means of screws 52. Stops 54 are provided on the slide plates 24 and 26 for maintaining the pairs of arms 40, 42 and 44, 46 in the aligned positions against the bias of the springs 50. However, the arrangement is such that the arms 40, 42 and 44, 46 are not in perfect alignment in a straight line but are inclined towards each other through an angle of about 1 to 3 degrees from the horizontal, which facilitates functioning of the applicator 10.

A guide roller 56 is mounted at the outer end of each arm for rotation about an axis 58.

In addition, a roller 60 is attached to the outside of each arm for rotation about an axis 62. Finally, a pair of rollers 64 is provided at opposite ends of the rear side of the body member 12. The rollers 64 are tapered on their inner sides, as shown at 66.

Figure 11:
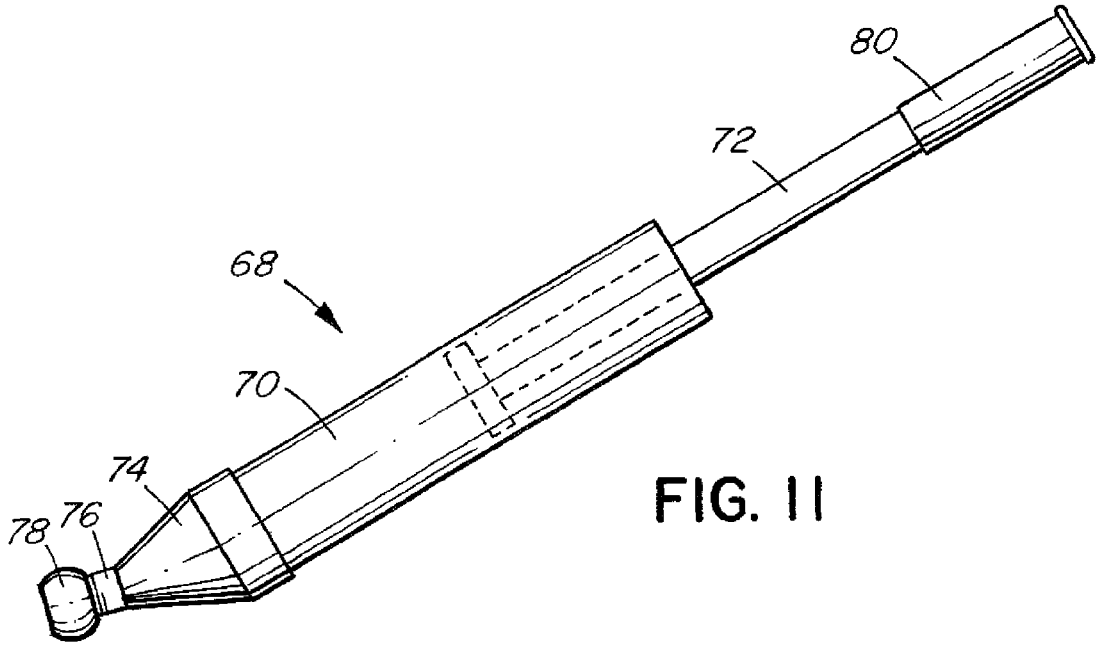
FIG. 11 is a side view of a handle or wand suitable for use with the applicator of FIG. 1.

With reference to FIG. 11, a handle or wand 68 is shown which is suitable for use with the applicator 10.

The handle 68 comprises a hollow cylinder 70 and a plunger 72. At its front end the cylinder is provided with a funnel-shaped section 74 ending in a screw-threaded open end 76 to which a hollow ball 78 having a matching screw thread is screwed. At its rear, the plunger 72 is provided with a handle 80.

An opening 82 is provided in the body member 12 for the passage of the material (mastic) being applied there through. The applicator 10 is attached to the handle 68 by means of a ball joint. The side of the opening 82 facing the upper side of the body member 12 is widened, as shown at 84, to house the ball 78 for forming the ball joint. A pair of cross wires 86 is provided to retain the ball 78 in position. The wires 86 are resilient to allow the ball 78 to be clicked into position.

Figure 16:
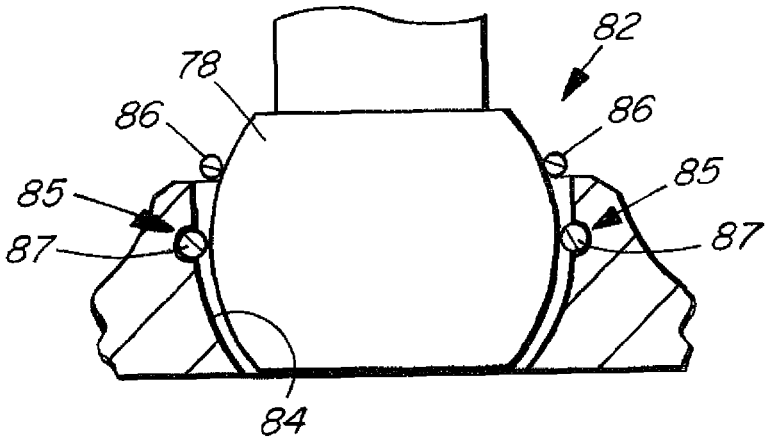
FIG. 16 is a part sectional view showing a ball joint connection connecting the handle of FIG. 11 to the applicator.

As shown in FIG. 16, an O-ring groove 85 is provided in the opening 82 provided in the opening 82 at a location which corresponds with the middle of the ball 78 when the ball 78 is in position in the opening 82. The groove 85 houses an O-ring 87 standing proud of the groove 85. This arrangement provides resistance to the movement of the ball 78 in the opening 82 and facilitates steering of the applicator 10 by means of the handle 68 when in use.

At its open end the ball 78 is provided with a further screw thread (not shown) to receive a screw-threaded tube of smaller or larger diameter to receive a connection to a different applicator, e.g. an applicator requiring a smaller amount of mastic for application to a surface. In this fashion, the handle 68 is adapted to be used with applicators other than the applicator 10.

Figure 9:
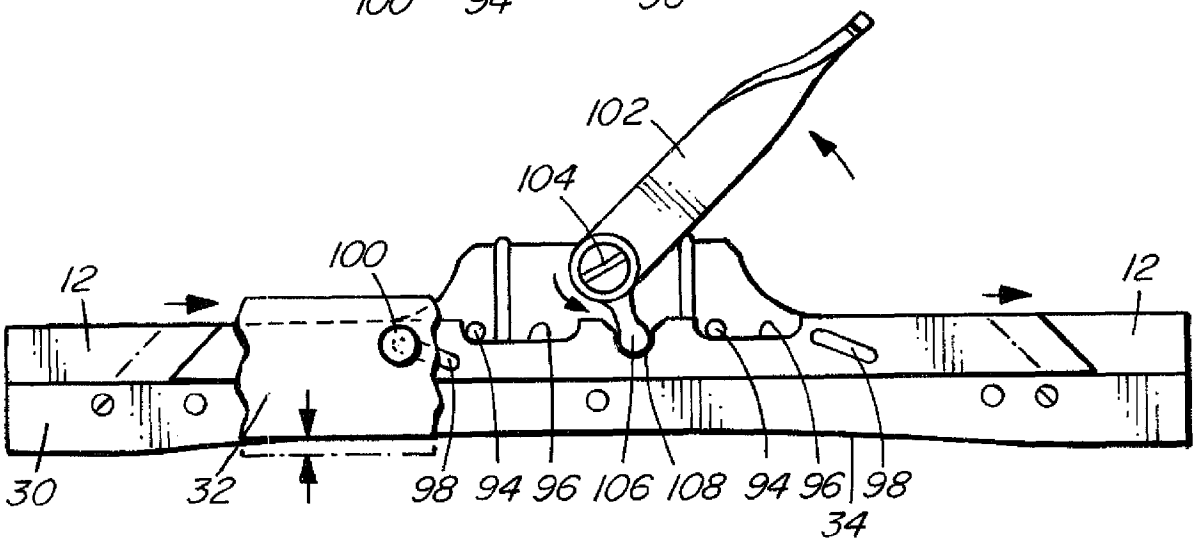
FIG. 9 is a view similar to FIG. 8 but showing the blade adjustment mechanism in a second limiting position.

A mechanism 90 for effecting the relative movement of the blades 30 and 32 is provided on the front side of the body member 12, as shown in FIGS. 1, 8 and 9.

The mechanism 90 comprises a sliding member 92 which is mounted for longitudinal movement along the front side of the body member 12 between a pair of limiting positions.

The body member 12 is provided with a pair of pins 94 and the member 92 is provided with a pair of longitudinal recesses 96 so that the member 92 can move from the one extreme position where the pins 94 are located towards the right extremity of the recesses 96, as shown in FIG. 8, to the other extreme position where the pins 94 are located towards the left extremity of the recesses 96. As shown, the sliding member 92 is located above the blade 30 and slides with respect to it, since the blade 30 is fixed relative to the body member 12.

Figure 10:
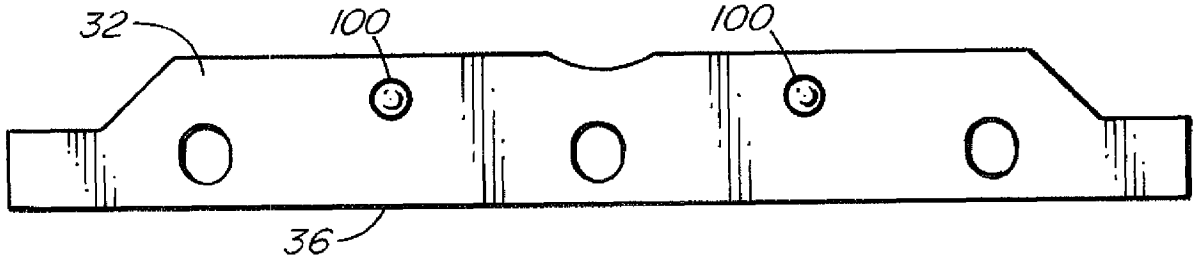
FIG. 10 is a rear view of the one of the relatively movable blades that is shown removed in FIGS. 8 and 9.

The sliding member 92 is also provided with a pair of slots 98 that are inclined to the horizontal. A pair of pins 100 is provided at the rear of the movable front blade 32 (FIG. 10). When the blades 30, 32 are in the assembled condition, a pin 100 is housed in each of the slots 98. When the member 92 is moved longitudinally from the one extreme position to the other, the pins 100 are moved along the inclined slots 98 from the one extreme position, as shown in FIG. 8, to the other extreme position, as shown in FIG. 9, thereby causing the movable blade 32 to be raised relative to the fixed blade 30.

A lever 102 which is pivotally connected to the body member 12 at 104, is provided for effecting the longitudinal movement of the sliding member 92. As shown, the lever 102 is provided with an arm 106 which is located in a recess 108 in the sliding member 92 so that movement of the lever 102 causes movement of the sliding member 92, as shown in FIGS. 8 and 9.

In use, the handle 68 is filled with mastic or other material to be applied to a drywall joint or surface. Normally this is done by pressing the plunger 72 forward into the cylinder 70, inserting the front end of the handle with the ball 78 into a pail of mastic and then pulling back the plunger 72 by means of the handle 80 so as to fill the cylinder 70 with mastic.

The above procedure, however, has the disadvantage that when the handle 68 is removed from the mastic in the pail, its front end is covered with mastic which needs to be wiped off before the ball 78 is clicked into position in the opening 82 in the applicator 10.

Figure 14:
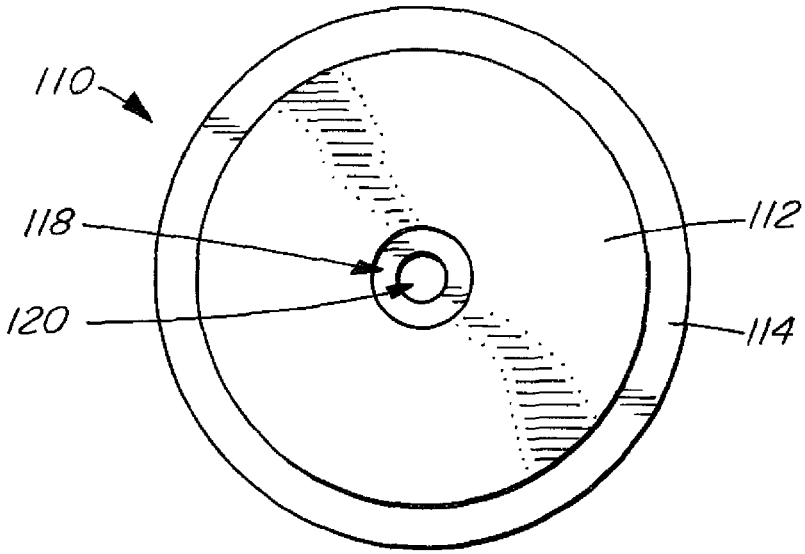
FIG. 14 is a plan view of a floating disc device suitable for use with the handle of FIG. 11.
Figure 15:
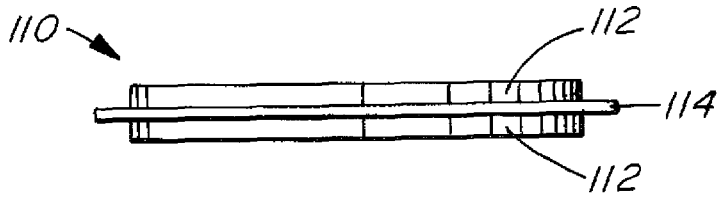
FIG. 15 is a side view of the disc of FIG. 14.

In order to address this problem, a floating disc 110 is provided, as shown in FIGS. 14 and 15. The disc 110 has the size and shape of the pail containing the mastic, such as circular in the present example.

The disc 110 comprises a pair of rigid outer members 112 between which a central disc 114 of a flexible material, such as rubber, is sandwiched. As can be seen, the central disc 114 has a diameter that is greater than the diameter of the outer members 112. The outer members 112 each has a central opening 118 and the flexible disc 114 has a central opening 120 of smaller diameter.

In use, the disc 110 floats on top of the mastic in the pail. The ball end of the handle 68 is inserted through the opening 120 in order to fill the handle with mastic. The disc 120 inhibits the rest of the handle 68 behind the ball 78 becoming soiled with mastic. In addition, when the ball 78 is removed from the opening 120, it is automatically wiped clean of mastic. Simultaneously, the disc 110 floating on the mastic causes the mastic to be pushed down evenly into the pail, thereby inhibiting a central hollow forming in the mastic which would require periodic smoothing.

Mastic is fed to the recess 16 in the applicator 10 by progressively pushing the plunger 72 forwardly into the cylinder 70 of the handle 68. In this way mastic is applied to the surface by pulling the applicator 10 over the surface using the handle 68. The fact that the handle 68 is connected to the applicator 10 by means of a ball joint allows the applicator 10 to follow an outside corner or other contour on the wall regardless of the position of the handle 68.

The applicator 10 can be used with the blades 30, 32 in the closed position, since mastic will pass through the gap 39. However, in situations where a greater amount of mastic is required, the blades 30, 32 can be adjusted as desired to increase the flow of mastic to the surface.

Figure 5:
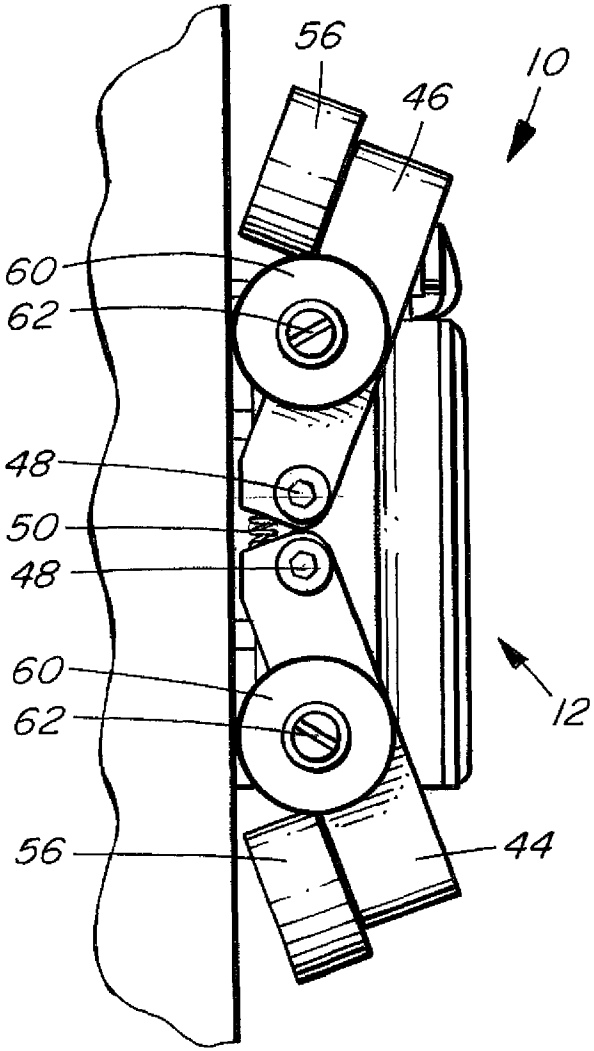
FIG. 5 is an end view of the applicator of FIG. 1 showing the applicator against a flat surface.

When the applicator 10 traverses a flat surface, the rollers 60 cause the arms 42, 44, 46 and 48 to move out of the way, as shown in FIG. 5. When a contour on the wall, such as an outer corner 57, as shown in FIG. 4, is encountered, the bias of the spring 50 causes the rollers 56 to be in the deployed position, in which the rollers 56 run along the edge of the outer corner 57. The fact that the arms 44, 46 are not in a straight aligned position but are inclined towards each other through an angle of about 1 to 3 degrees from the horizontal, assists in preventing the rollers 56 to ride up against the corner and therefore become disengaged from the corner 57. This is particularly useful in situations where the outside corner 57 does not form a straight line but is curved.

When one pair of arms, such as arms 44 and 46, as shown in FIG. 4, are in engagement with a corner, the other pair of arms 40, 42 will be in the retracted position, similar to the position of the arms 44, 46 depicted in FIG. 5. Therefore, the applicator 10 can be moved between flat surfaces and corner joints and will adjust itself automatically for each position.

Figure 12:
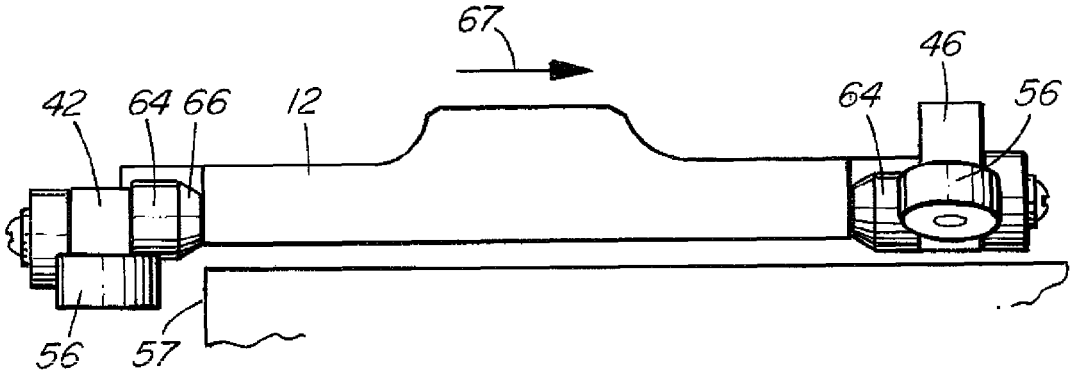
FIGS. 12 and 13 are schematical drawings illustrating the functioning of the applicator of FIG. 1.
Figure 13:
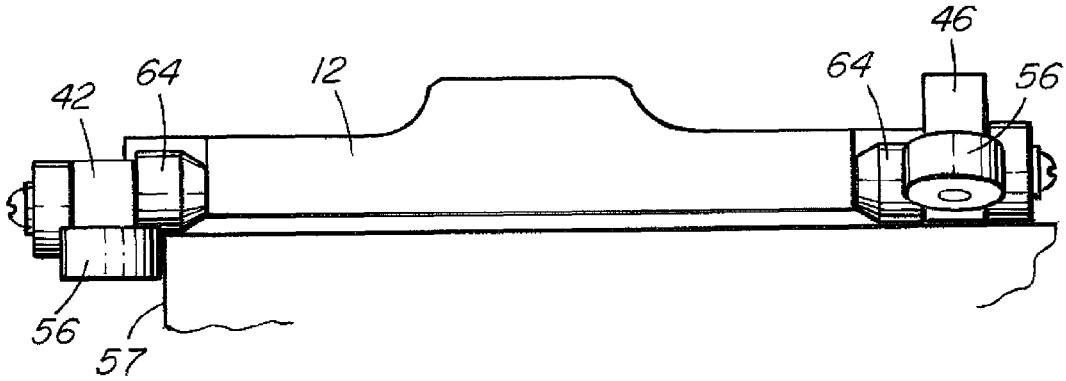

The function of the tapered rollers 64 in facilitating engagement of the applicator 10 in engaging with an outside corner 57 is illustrated in FIGS. 12 and 13. It can be seen from the relative positions shown in these figures that engagement with the outside corner 57 is easily effected by simple sideways movement of the applicator 10 in the direction of the arrow 67. As shown in FIG. 12, movement of the roller 64 over the corner 57 is facilitated by the recess 66 on the roller 64.

The claims which follow are to be considered an integral part of the present disclosure. Although certain preferred embodiments of the present invention have been shown and described in detail, it should be understood that various changes and modifications may be made therein without departing from the scope of the appended claims. In general, in the following claims, the terms used should not be construed to limit the invention to the specific embodiments disclosed in the specification, but should be construed to include all methods and apparatuses that operate in accordance with the claims. Accordingly, the invention is not limited by the disclosure, but instead its scope is to be determined entirely by the following claims.

What is claimed is:

1. An applicator for applying drywall mastic or other material to a flat drywall surface or to an outside corner drywall joints or other surface comprising:

a body member having a front, a rear, a pair of sides and an upper surface and a lower surface, the lower surface being provided with a recess for containing the material prior to the application thereof;

at least one pair of opposed arms pivotally mounted on one of the sides of the body member for movement between deployed and retracted positions about pivot points that are spaced from each other along the side of the body member, the pivot point of each arm being located at one end of the arm and the arms of the pair extending away from each other along the side of the body member, terminating at an outwardly facing end of each arm;

a corner guide at the outwardly facing end of each arm extending beyond the lower surface of the body member when the arm is in the deployed position in order to track an outside edge of a drywall corner joint; and a biasing member for biasing the pair of arms to the deployed position when the arms are not located over a flat drywall surface and for allowing the arms to move to the retracted position when the arms are located over a flat drywall surface.

2. The applicator of claim 1, wherein the corner guide comprises a guide roller at the outwardly facing end of each arm for rotation about an axis extending transversely of the arm, the roller extending beyond the lower surface of the body member when the arm is in the deployed position in order to track an outside edge of a drywall corner joint.

3. The applicator of claim 1, wherein a pair of the opposed arms is provided on each side of the body member.

4. The applicator of claim 1, further comprising a side roller on the side of each arm for engagement with a flat drywall surface for moving the arms to the retracted position.

5. The applicator of claim 1, wherein the biasing member comprises a coil spring extending between the arms.

6. The applicator of claim 1, further comprising a pair of secondary rollers located on opposite sides of the body member at the rear of the body member.

7. The applicator of claim 6, wherein the secondary rollers have rolling surfaces which are tapered towards the sides of the body member.

8. The applicator of claim 1, wherein the recess is of an elongate shape with a leading edge facing the front of the body member.

9. The applicator of claim 1, further comprising a pair of slide plates on the lower surface of the body member respectively located along the opposite sides of the body member, the slide plates being in the same plane to define an applicator surface for contact with a drywall surface to which the material is being applied.

10. The applicator of claim 1, further comprising a pair of relatively movable blades at the front of the body member for controlling flow of the material from the recess.

11. The applicator of claim 10, wherein the one blade is fixed relative to the body member and the other blade is movable relative to the body member.

12. The applicator of claim 11, wherein the fixed blade has a curved edge and the movable blade has a straight edge in operational relationship with the curved edge, whereby relative movement of the blades progressively covers or uncovers the curved edge in order to control an amount of the material flowing past the blades.

13. The applicator of claim 10, further comprising a mechanism for effecting relative movement of the blades, the mechanism comprising an elongate member on the body member capable of elongate movement relative to at least one of the blades, the elongate member being provided with at least one slot therein that is inclined with respect to a direction longitudinally of the at least one blade, the at least one blade being provided with a pin thereon which is located for sliding along the inclined slot, whereby longitudinal movement of the elongate member relative to the at least one blade causes movement of the at least one blade in a transverse direction relative to the other blade.

14. The applicator of claim 10, further comprising a cover member for at least partially covering the recess in the lower surface of the body member, the cover member defining an opening adjacent the relatively movable blades for the passage of the material from the recess there through.

15. The applicator of claim 1, wherein the body member is provided with an opening extending between the upper surface and the lower surface for connection of the recess in the lower surface to a source of the material to be applied to the surface.

16. The applicator of claim 15, wherein the source of the material comprises a handle or wand provided with a reservoir for containing the material.

17. The applicator of claim 16, wherein the opening is shaped to receive a ball forming part of a ball joint for connecting the handle or wand to the applicator.

18. The applicator of claim 17, wherein the opening is provided with an O-ring groove at a location which corresponds with the middle of the ball when the ball is located in the opening, the O-ring groove housing an O-ring standing proud of the groove for providing resistance to movement of the ball in the groove.

19. The applicator of claim 17, further comprising a pair of resilient members extending across the opening in spaced relationship for retaining the ball in the opening.

20. The applicator of claim 1, further comprising a cover member for at least partially covering the recess in the lower surface of the body member.

21. An applicator for applying drywall mastic or other material to a drywall surface or other surface, comprising a body member having an upper surface and a lower surface, a recess in the lower surface for connection to a source of the material to be applied to the surface and a pair of relatively movable blades located in operational relationship with respect to each other for controlling flow of the material from the recess to the surface, wherein the one blade is fixed relative to the body member and the other blade is movable relative to the body member, and wherein the fixed blade has a curved edge and the movable blade has a straight edge in operational relationship with the curved edge, whereby relative movement of the blades progressively covers or uncovers the curved edge in order to control an amount of the material flowing past the blades.

22. An applicator for applying drywall mastic or other material to a drywall surface or other surface, comprising a body member having an upper surface and a lower surface, a recess in the lower surface for connection to a source of the material to be applied to the surface and a pair of relatively movable blades located in operational relationship with respect to each other for controlling flow of the material from the recess to the surface and mechanism for effecting relative movement of the blades, the mechanism comprising an elongate member on the body member capable of elongate movement relative to at least one of the blades, the elongate member being provided with at least one slot therein that is inclined with respect to a direction longitudinally of the at least one blade, the at least one blade being provided with a pin thereon which is located for sliding along the inclined slot, whereby longitudinal movement of the elongate member relative to the at least one blade causes movement of the at least one blade in a transverse direction relative to the other blade.

23. The applicator of claim 22, further comprising a cover member for at least partially covering the recess in the lower surface of the body member, the cover member defining an opening adjacent the relatively movable blades for the passage of the material from the recess there through.

* * * * *